US010171910B2

(12) United States Patent
Ashrafzadeh

(10) Patent No.: US 10,171,910 B2
(45) Date of Patent: Jan. 1, 2019

(54) METHODS AND DEVICES FOR REPRODUCING STEREO AUDIO

(71) Applicant: D2A Audio LLC, Morgan Hill, CA (US)

(72) Inventor: Ahmad Rick Ashrafzadeh, Morgan Hill, CA (US)

(73) Assignee: D2A Audio LLC, Morgan Hill, CA (US)

( * ) Notice: Subject to any disclaimer, the term of this patent is extended or adjusted under 35 U.S.C. 154(b) by 0 days.

(21) Appl. No.: 15/603,838

(22) Filed: May 24, 2017

(65) Prior Publication Data

US 2018/0343521 A1 Nov. 29, 2018

(51) Int. Cl.

| | |
|---|---|
| ***H04R 5/02*** | (2006.01) |
| ***H04R 3/14*** | (2006.01) |
| ***H04R 5/04*** | (2006.01) |
| ***H04R 1/26*** | (2006.01) |
| ***H04S 3/00*** | (2006.01) |
| ***H04R 3/04*** | (2006.01) |

(52) U.S. Cl.
CPC ..... *H04R 5/02* (2013.01); *H04R 1/26* (2013.01); *H04R 3/04* (2013.01); *H04R 3/14* (2013.01); *H04R 5/04* (2013.01); *H04S 3/008* (2013.01)

(58) Field of Classification Search
CPC ... H04R 5/02; H04R 1/26; H04R 3/04; H04R 3/14; H04R 5/04; H04S 3/008
See application file for complete search history.

(56) References Cited

U.S. PATENT DOCUMENTS

| | | | | |
|---|---|---|---|---|
| 4,884,655 A * | 12/1989 | Freadman et al. | ..... | H04R 1/288 181/145 |
| 2006/0013406 A1* | 1/2006 | Risch et al. | ..... | H04R 3/14 381/18 |
| 2015/0195652 A1* | 7/2015 | Barone et al. | ..... | H04R 5/00 381/300 |

* cited by examiner

*Primary Examiner* — Andrew L Sniezek
(74) *Attorney, Agent, or Firm* — Vitality IP; Saleh Kaihani

(57) ABSTRACT

Disclosed are stereo sound system devices and methods for reproducing stereo sound with improved auditory experience and reduced speaker rattle. In some embodiments, the disclosed arrangement of speakers on the sound system housing and driving low frequency speakers with the same signal contribute to the improved auditory experience and reduced speaker rattle effect.

22 Claims, 5 Drawing Sheets

METHODS AND DEVICES FOR REPRODUCING STEREO AUDIO

BACKGROUND

Field of the Invention

This invention relates generally to stereo audio sound systems, and more particularly, to methods and devices for reproducing stereo audio with improved auditory experience and reduction in speaker rattle effect.

Description of the Related Art

Audible sound can comprise of a range of frequencies. It can be difficult to optimize a single audio speaker to output the entire range of audible sound frequencies. Therefore, audio speakers are often optimized for a given range of frequencies. For example, audio speakers, termed tweeters, can be optimized to output high frequency sounds and audio speakers, termed woofers, can be optimized to output low frequency sounds. The range of audible sound frequencies can further be divided and corresponding audio speakers may be designed and optimized to output a given frequency range. Besides woofers and tweeters, subwoofers, super tweeters and midrange speakers exist each outputting a range of frequencies based on their specification. In sound systems, two or more speakers can be combined to enhance the auditory experience and output a wider range of sound frequencies. However, existing sound systems can suffer from low sound quality, rattle or shake in speaker housing and even physical movement of the housing.

SUMMARY

In one aspect of the invention, an audio system is disclosed. The audio system includes: an input configured to receive left and right stereo input signals; a left filter configured to receive the left stereo input signal and isolate left low frequency signal and left high frequency signal; a right filter configured to receive the right stereo input signal and isolate right low frequency signal and right high frequency signal; left and right high frequency speakers; top and bottom low frequency speakers; left high frequency amplifier configured to amplify the left high frequency signal and drive the left high frequency speaker with the amplified left high frequency signal; right high frequency amplifier configured to amplify the right high frequency signal and drive the right high frequency speaker with the amplified right high frequency signal; a summing amplifier configured to receive the left and right low frequency signals and generate a combined low frequency signal; and a low frequency amplifier configured to receive the combined low frequency signal, output an amplified combined low frequency signal and drive the top and bottom low frequency speakers with the amplified combined low frequency signal.

In one embodiment, the audio system further includes a housing, wherein the housing comprises top and bottom surfaces, and the top low frequency speaker is mounted on the top surface of the housing and the bottom low frequency speaker is mounted on the bottom surface of the housing, wherein the bottom surface of the housing further comprises support features for supporting the housing on an external surface.

In one embodiment, the housing further comprises side surfaces and the left and right high frequency speakers are mounted on opposing or adjacent side surfaces of the housing.

In one embodiment, the audio system further includes high frequency speakers on all side surfaces of the housing.

In one embodiment, the left and right high frequency speakers are replaced with left and right mid-range speakers, the left filter is configured to filter left midrange frequencies, the right filter is configured to filter right midrange frequencies, the left and right high frequency amplifiers are configured to amplify the left and the right midrange frequencies and drive the left and the right midrange speakers.

In some embodiments, the housing further comprises side surfaces and the mid-range speakers are mounted on opposing or adjacent side surfaces of the housing.

In some embodiments, the audio system, further includes mid-range speakers on all side surfaces of the housing.

In some embodiments, a distance between the top and bottom low frequency speakers in the housing is such that volume droop, within a distance of about 30 feet from the housing, is improved by at least 20% compared to sound systems lacking low frequency speakers on top and bottom surfaces.

In another embodiment, the low frequency amplifier further comprises a volume control functioning as bass control.

In another aspect of the invention, an audio system includes: an input configured to receive left and right stereo input signals; a left filter configured to receive the left stereo input signal and filter a left high frequency signal; a right filter configured to receive the right stereo input signal and filter a right high frequency signal; left and right high frequency speakers; top and bottom low frequency speakers; a left high frequency amplifier configured to amplify the left high frequency signal and drive the left high frequency speaker with the amplified left high frequency signal; a right high frequency amplifier configured to amplify the right high frequency signal and drive the right high frequency speaker with the amplified right high frequency signal; a summing amplifier configured to receive the left and right stereo input signals and generate a summed signal; a low pass filter configured to receive the summed signal and generate a low frequency summed signal; and a low frequency amplifier configured to receive the low frequency summed signal, output an amplified low frequency summed signal and drive the top and bottom low frequency speakers with the amplified low frequency summed signal.

In some embodiments, the audio system further includes a housing, wherein the housing comprises top and bottom surfaces, and the top low frequency speaker is mounted on the top surface of the housing and the bottom low frequency speaker is mounted on the bottom surface of the housing, wherein the bottom surface of the housing further comprises support features for supporting the housing on an external surface.

In another embodiment, the housing further comprises side surfaces and the left and right high frequency speakers are mounted on opposing or adjacent side surfaces of the housing.

In one embodiment, the audio system further includes high frequency speakers on all side surfaces of the housing.

In another embodiment, the left and right high frequency speakers are replaced with left and right mid-range speakers, the left filter is configured to filter left midrange frequencies, the right filter is configured to filter right midrange frequencies, the left and right high frequency amplifiers are configured to amplify the left and the right midrange frequencies and drive the left and the right midrange speakers.

In one embodiment, the housing further comprises side surfaces and the mid-range speakers are mounted on opposing or adjacent side surfaces of the housing.

In some embodiments, the audio system further includes mid-range speakers on all side surfaces of the housing.

In another embodiment, a distance between the top and bottom low frequency speakers in the housing is such that volume droop, within a distance of about 30 feet from the housing, is improved by at least 20% compared to sound systems lacking low frequency speakers on top and bottom surfaces.

In some embodiments, the low frequency amplifier further comprises a volume control functioning as bass control.

In another aspect of the invention, a method of reproducing stereo audio is disclosed. The method includes: receiving left and right stereo input signals; filtering the left stereo input signal to isolate a left high frequency signal; amplifying the left high frequency signal; driving a left high frequency speaker with the amplified left high frequency signal; filtering the right stereo input signal to isolate a right high frequency signal; amplifying the right high frequency signal; driving a right high frequency speaker with the amplified right high frequency signal; summing the left and right stereo input signals into a summed signal; filtering the summed signal to isolate a low frequency summed signal; amplifying the low frequency summed signal; and driving a top low frequency speaker and a bottom low frequency speaker with the amplified low frequency summed signal.

In one embodiment, the method further includes providing a housing, wherein the housing comprises top and bottom surfaces, and the top low frequency speaker is mounted on the top surface of the housing and the bottom low frequency speaker is mounted on the bottom surface of the housing, wherein the bottom surface of the housing further comprises support features for supporting the housing on an external surface.

BRIEF DESCRIPTION OF THE DRAWINGS

These drawings and the associated description herein are provided to illustrate specific embodiments of the invention and are not intended to be limiting.

DETAILED DESCRIPTION

Figure 1:
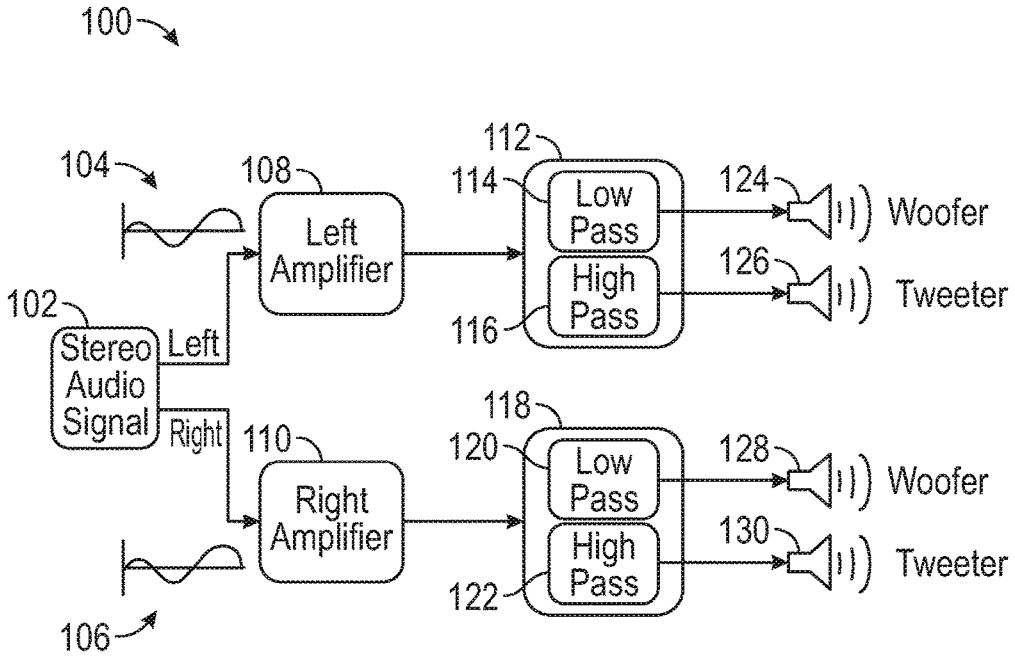
FIG. 1 illustrates an example of an application where embodiments of the invention may advantageously be used to improve auditory experience and reduce speaker rattle.

The following detailed description of certain embodiments presents various descriptions of specific embodiments of the invention. However, the invention can be embodied in a multitude of different ways as defined and covered by the claims. In this description, reference is made to the drawings where like reference numerals may indicate identical or functionally similar elements.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "about" as used herein refers to the ranges of specific measurements or magnitudes disclosed. For example, the phrase "about 10" means that the number stated may vary as much as 1%, 3%, 5%, 7%, 10%, 15% or 20%. Therefore, at the variation range of 20% the phrase "about 10" means a range from 8 to 12.

When the terms "one", "a" or "an" are used in the disclosure, they mean "at least one" or "one or more", unless otherwise indicated.

Stereo sound systems can receive a stereo input audio signal generated by recording sound and reproduce the recorded sound via one or more speakers where speakers are optimized for outputting a frequency range. The input audio signal can include two or more audio channels, each generated from two or more audio recording devices such as microphones. By recording the same audio source via separate recording devices and reproducing the recordings, one can simulate a live listening experience and improve auditory experience.

Audio channels can carry a range of audible frequencies. Each audio channel can be used to drive one or more audio speakers, where the audio speakers are optimized for a frequency range. For example, a channel can carry low frequency audio (e.g., frequencies less than 500 Hz) and drive one or more woofers. The channel can additionally include high frequency audio (e.g., frequencies from 500 Hz to 20 KHz) and can drive one or more tweeters. In many sound systems, the audio channels carry different frequency ranges and the frequency ranges are separated and fed to appropriate speakers optimized for reproducing those frequencies. The audio signal may be amplified or pass through various filters before driving audio speakers.

FIG. 1 is a diagram of a sound system 100 for receiving a stereo audio signal 102 and driving multiple speakers. For ease of description, the audio signal 102 is shown to carry two channels, a left channel 104 and a right channel 106. However, persons with ordinary skill in the art can implement the embodiments described herein when the audio signal 102 carries more than two audio channels. The audio signal 102 can come from a variety of sources including devices capable of storing stereo audio, for example, from a computer, tablet, smart phone, record player, or other analog or digital devices.

The left audio channel 104 can be amplified by a left amplifier 108. The amplified left audio channel 104 can be inputted to a crossover circuit 112. Crossover circuits can be utilized in audio applications to split an audio signal into two or more frequency ranges, such that the signals can be routed to their corresponding optimized drivers and audio speakers. The crossover circuit 112 can include a low pass filter 114 for filtering the amplified left audio channel 104 and outputting low frequencies. The low frequencies outputted from the low pass filter 114 can be used to drive woofer speaker 124. The crossover circuit 112 can additionally include a high pass filter 116 for filtering the amplified left audio channel 104 and outputting high frequencies. The high frequencies outputted from the high pass filter 116 can be used to drive tweeter speaker 126.

The right audio channel 106 can be amplified by a right amplifier 110. The amplified right audio channel 106 can be inputted to a crossover circuit 118. The crossover circuit 118 can include a low pass filter 120 for filtering the amplified right audio channel 106 and outputting low frequencies. The low frequencies outputted from the low pass filter 120 can be used to drive woofer speaker 128. The crossover circuit 118 can additionally include a high pass filter 122 for filtering the amplified right audio channel 106 and outputting high frequencies. The high frequencies outputted from the high pass filter 122 can be used to drive tweeter speaker 130.

The crossover circuits 112 and 118 can separate frequencies with low pass filters, high pass filters and while not shown they can use bandpass or other filters to achieve separation of frequencies. These filters can in turn use passive elements such as capacitors, resistors or inductors to achieve separation of frequencies.

Conventional crossover circuits can be bulky, heavy and expensive to implement. They can adversely affect the output sound quality. Additionally, woofers and subwoofers (if used) and when driven with different input signals, can experience speaker rattle effect. In some cases, the sound system housing or enclosure can experience undesirable physical movement during sound reproduction. Speakers reproduce sound waves by modulating, moving or oscillating a diaphragm. In the case of low frequencies, the movement of the diaphragms of multiple woofer or subwoofer speakers when reproducing sound waves based on different input signals can cause speaker rattle due to natural resonance, undesirable harmonics or other factors. Compared with reproducing high frequency sounds, reproducing low frequency sounds generates much more energy. Additionally, lower frequencies can be closer to the natural resonant frequency of the speaker system. As a result, reproducing low frequency sounds are sometimes responsible for the majority of undesirable speaker rattle. The disclosed embodiments can drive low frequency speakers with the same signal, output low frequency sounds from top and bottom low frequency speakers in opposite directions with one low frequency speaker directing its output towards a supporting surface on which the sound system is resting, and where that low frequency speaker is relatively near to the supporting surface. The supporting surface can for example be a table surface, floor surface or other surface on which the speaker system housing is placed. Driving low frequency speakers in this arrangement can reduce undesirable speaker rattle effect. Additionally, and as will be described, low frequency and high frequency components of a stereo audio signal can be separated or isolated before amplification, and amplifiers can be used after separation to amplify the separated signals.

Figure 2:
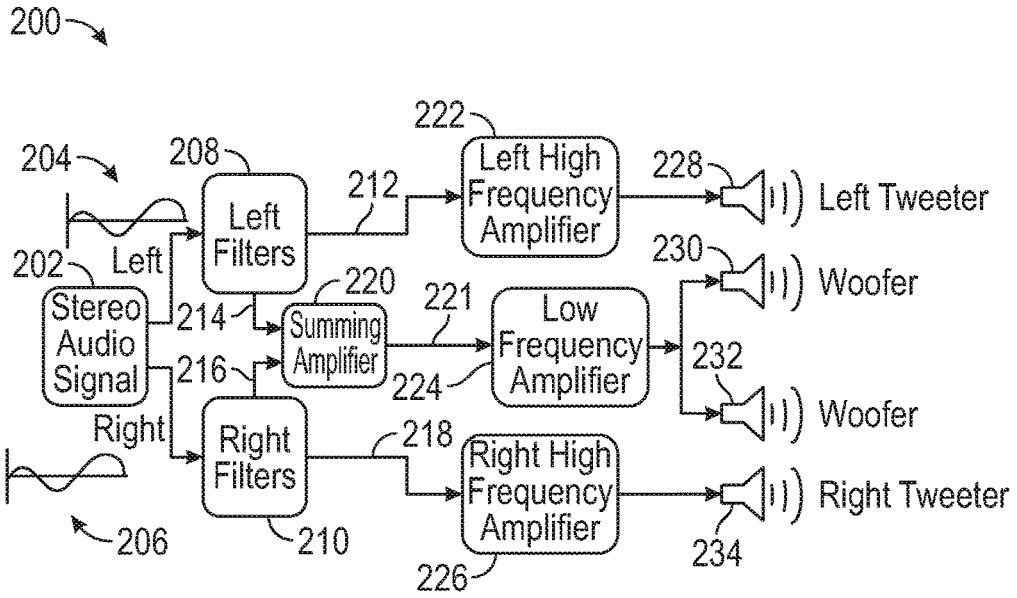
FIG. 2 is a diagram of a stereo sound system according to an embodiment.

FIG. 2 is a diagram of a stereo sound system according to an embodiment. The stereo audio signal 202 can include a left audio channel 204 and a right audio channel 206.

The left audio channel 204 can be filtered by left filters 208 generating a left high frequency signal 212 and a left low frequency signal 214. The right audio channel 206 can be filtered by right filters 210 generating a right low frequency signal 216 and a right high frequency signal 218. The left high frequency signal 212 can be amplified by a left high frequency amplifier 222 and the output can be used to drive a left high frequency speaker 228. Similarly, the right high frequency signal 218 can be amplified by a right high frequency amplifier 226 and the output can be used to drive a right high frequency speaker 234. The left and right high frequency amplifiers can be amplifiers optimized for handling high frequency signals. The left and right high frequency amplifiers can be tweeter amplifiers. In some embodiments, they can be optimized to handle frequencies between 500 Hz to 20 KHz. Optionally, while not shown, the left and right filters 208 and 210 can include additional circuitry to further filter and isolate more frequency components such as midrange frequencies. The additional frequency components can be routed to their respective optimized amplifiers to drive their corresponding audio speakers.

The left and right filters 208 and 210 can be implemented using small signal RLC (resistor, inductor and/or capacitor) networks. In a preferred embodiment, active filters are used to implement left and right filters 208 and 210. Active filters can use active components such as amplifiers and in some cases eliminate the need for using bulky and expensive inductors. Active filters can improve the performance of filters 208 and 210 and bring predictability to their operations.

Sound systems are sometimes designed to simulate a live listening experience in part by reproducing sounds that come from multiple locations or appear to come from multiple directions. Low frequency sounds are less directional. In the case of low frequency sounds, the auditory experience is only marginally affected by the location where the low frequency sounds come from. As such, the auditory experience is not significantly dependent on where the low frequency sounds are reproduced in an audio speaker system. Because the low frequencies are less directional, the left low frequency signal 214 and the right low frequency signal 216 can be combined using a summing amplifier 220, with negligible deterioration in auditory experience. The combined low frequency signal 221 can be used to drive two low frequency audio speakers (e.g., woofers) 230 and 232 positioned in opposing directions from one another in a housing of the stereo sound system 200. The positioning of the speakers 228, 230, 232 and 234 in relation to a housing of the stereo sound system 200 will further be described in relation to FIGS. 5A-D. The combined low frequency signal 221 can be amplified by a low frequency amplifier 224. The amplified combined low frequency signal can be used to drive low frequency audio speakers (e.g., woofers) 230 and 232. When low frequency audio speakers 230 and 232 are mounted on top and bottom surfaces of a housing of the sound system 200, with one fairly close to the surface supporting the speaker housing and directing its output towards the supporting surface, and when both low frequency speakers 230 and 232 are driven by the same signal (e.g., amplified combined low frequency signal), speaker rattle effect and undesirable speaker housing movement is nearly canceled and the auditory experience is pleasant and improved. In some embodiments, the low frequency speaker near the supporting surface can be as close as one to two inches from the supporting surface. The supporting surface can be any surface on which the sound system housing is placed. For example, the speaker housing may be placed on a floor or a table.

The summing amplifier 220 and low frequency amplifier 224 can be amplifiers optimized for handling low frequency signals. For example, the low frequency amplifier can be a woofer amplifier. In some embodiments, the summing amplifier and the low frequency amplifier can be optimized to handle frequencies less than 500 Hz. In other embodiments, while not shown, the filters 208 and 210 can be configured to filter and isolate more frequency components, route them to summing amplifiers, amplify the combined signal using an appropriately optimized amplifier and drive their corresponding audio speakers. For example, the filters 208 and 210, in addition to filtering high frequency signals 212, 218 and low frequency signals 214, 216 can be configured to isolate subwoofer or midrange frequency components. The resulting frequency components can be routed in similar fashion as described in relation to the stereo sound system 200. For example, higher range frequencies can be fed through their individual amplifiers and drive their corresponding high frequency audio speakers, such as mid-range, tweeter or super tweeter speakers, while lower range frequencies can be combined using one or more summing amplifiers. The combined signals can be individually amplified and used to drive their corresponding optimized low frequency audio speakers, such as woofers or subwoofers. The cut-off, for determining which frequencies are fed through individual amplifiers and which frequencies are combined, can depend on a variety of factors, for example, the overall design of the sound system 200, the number of speakers in each range, and commercial considerations. For example, in a preferred embodiment, woofers and tweeters are used. In another embodiment, a subwoofer unit can be used as an external unit, which receives the corresponding signal via wired or wireless connection.

In one embodiment, an equalization function can be implemented for the sound system 200 as a preset function. For example, in one embodiment, a user can choose between four preset functions. The low frequency speakers 230 and 232 are driven by the low frequency amplifier 224 separate from the high frequency amplifiers 222 and 226. Therefore, a volume control can be added to the low frequency amplifier 224, which in effect acts as bass control. Additionally, the sound system 200 can include a master volume control via which a user can adjust the amplitude of signals outputted by the speaker system 200.

Figure 3:
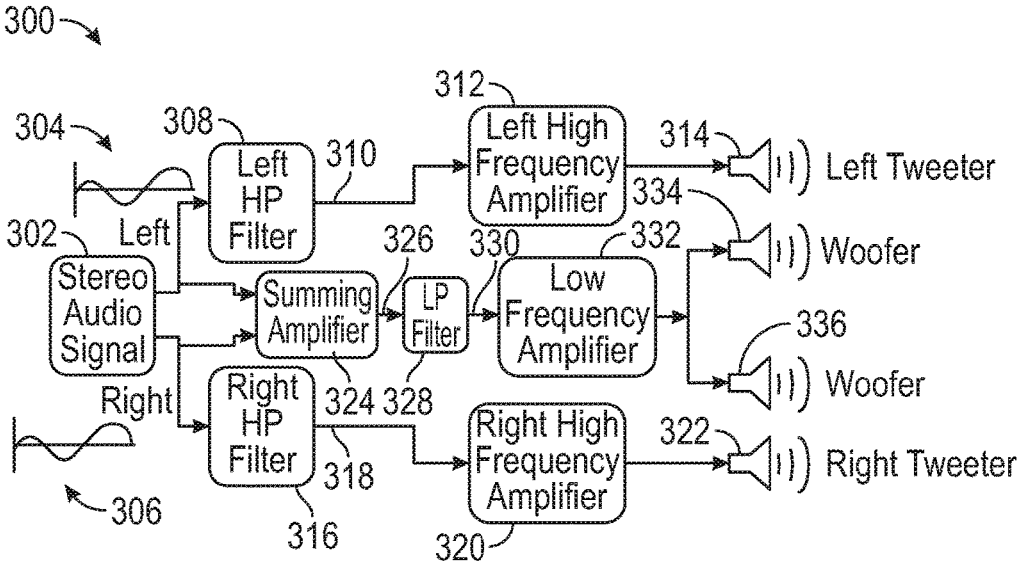
FIG. 3 is a diagram of an alternative stereo sound system according to an embodiment.

FIG. 3 is a diagram of an alternative stereo sound system according to an embodiment. The stereo audio signal 302 can include a left audio channel 304 and a right audio channel 306.

The left audio channel 304 can be filtered by left high pass filter 308 generating a left high frequency signal 310. The left high frequency signal 310 can be amplified by a left high frequency amplifier 312 and the output can be used to drive a left high frequency speaker (e.g. tweeter) 314. Similarly, the right audio channel 306 can be filtered by right high pass filter 316 generating a right high frequency signal 318. The right high frequency signal 318 can be amplified by a right high frequency amplifier 320 to drive a right high frequency speaker (e.g. tweeter) 322. The embodiment of the speaker system 300 can be used with the speaker housing embodiment described in relation to FIGS. 5A-D.

The left and right audio channels 304 and 306 can be added with a summing amplifier 324 generating a summed audio signal 326. The summed audio signal 326 can be filtered by a low pass filer 328 generating a low frequency summed signal 330. The low frequency summed signal 330 can be amplified by a low frequency amplifier 332 to drive low frequency speakers (e.g., woofers) 334 and 336.

In effect, in the sound system 300, the unfiltered audio channels are summed before low pass filtering. Such an arrangement increases the efficiency of the sound system 300 and uses fewer components compared to other sound systems. Similar to the sound system 200, when low frequency audio speakers 334 and 336 are mounted on top and bottom surfaces of a housing of the sound system 300, with one fairly close to the surface supporting the speaker housing and directing its output towards the supporting surface, and when both low frequency speakers 334 and 336 are driven by the same signal (e.g., amplified low frequency summed signal), speaker rattle effect and undesirable speaker housing movement is nearly canceled and the auditory experience is pleasant and improved. Similar to the sound system 200, the low frequency speaker of the sound system 300 near the supporting surface can be as close as one to two inches from a supporting surface, such as a table surface or a floor surface.

While not shown, in some embodiments of FIGS. 2 and 3, the high frequency speakers can also be driven by the same signal (mono stereo). In other embodiments, multiple high frequency speakers can be chosen and the same or stereo signals or a combination of stereo or mono signals can be used to drive the high frequency speakers. For example, four high frequency speakers can be used when two are driven using the left high frequency signal and two are driven with the right high frequency signal. In other embodiments, all four high frequency speakers can be driven using the same signal. One, two, three or other number of high frequency speakers can also be used.

Figure 4:
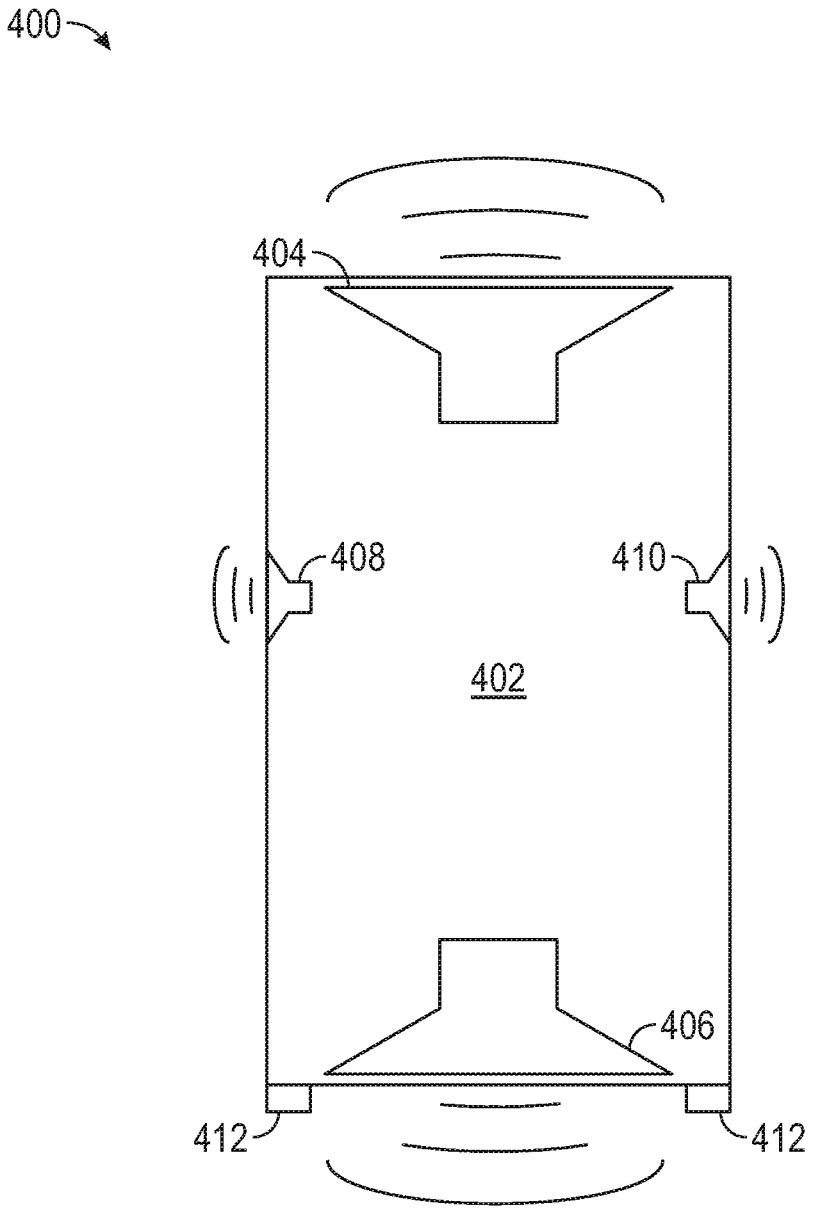
FIG. 4 is a diagram of a sound system housing, which can be used in combination with the embodiments of FIGS. 2 and 3.

FIG. 4 is a diagram 400 of a stereo speaker housing 402, which can be utilized to house a sound system, for example the sound system 200 or 300. The stereo sound systems 200 or 300 as described in relation to FIGS. 2 and 3 can be housed in a housing 402. The housing 402 can be in the form of a cube, cuboid, cylinder, cone, triangular prism, hexagonal prism, various pyramid shapes, sphere, elliptical sphere or other shapes. In some embodiments, the housing 402 can substantially including surfaces: front, back, top, bottom, left and right surfaces. In some embodiments, the surfaces may be orthogonal or parallel with respect to the other surfaces; they may be straight or they may be formed with curvature or other aesthetics desired for a speaker housing. In some embodiments, the housing 402 may include one or more support structures or stands 412 on one or more of its surfaces for propping up and supporting the housing 402 on an external surface such as a table or on the ground.

In one embodiment, the low frequency speakers (e.g., woofers) 404 and 406 can be mounted on a top and bottom surfaces of the housing 402, respectively. The low frequency speaker 406 is within a few inches of the supporting surface on which the stereo speaker housing 402 is rested. The output of the low frequency speaker 406 is directed to the external surface on which the housing 402 rests. The low frequency speakers 404 and 406 can be the low frequency speakers 230, 232, 334 or 336 as described in relation to the embodiments of the sound systems 200 and 300. As described in relation to FIGS. 2 and 3, when low frequency speakers are arranged on top and bottom surfaces of the housing 402, with one being near the supporting surface and directing its output towards the supporting surface and where the low frequency speakers are driven in phase, rattling effects and physical movement are minimized and the auditory experience is pleasant and is improved. In some embodiments, the high frequency speakers (e.g., tweeters) 408 and 410 can be mounted on a left and right surfaces of the housing 402, respectively. The high frequency speakers 408 and 410 can be the high frequency speakers (tweeters) 228, 234, 314 or 322 as described in relation to the embodiments of the sound systems 200 and 300.

FIGS. 5A-D illustrate different views of an exemplary implementation of a speaker housing 500 according to the embodiment of FIG. 4.

Figure 5A:
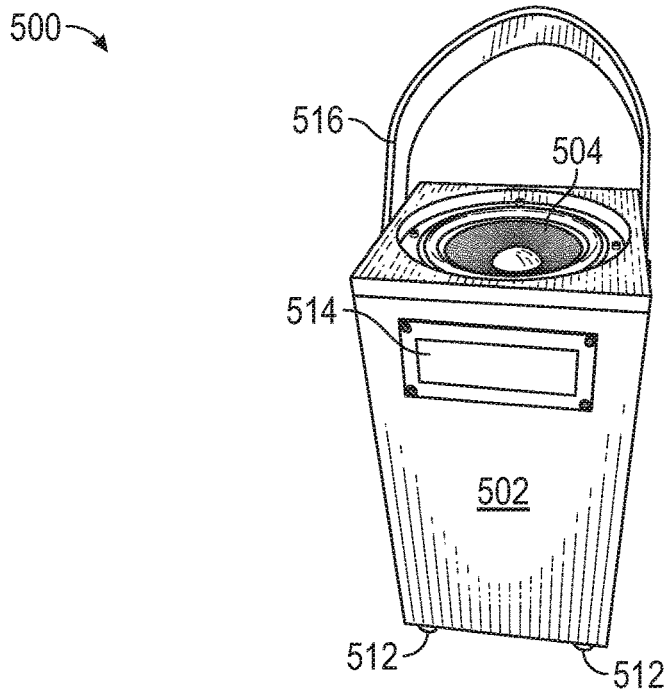
FIGS. 5A-D illustrate different views of an implementation of the sound system housing of FIG. 4.

FIG. 5A illustrates a front view of the speaker housing 502. In some embodiments, the stereo speaker housing 502 can include a display 514 for displaying status information or parameters relevant to the housed stereo sound system. In some embodiments, the display 514 can be a touch display for interacting with the stereo sound system. In some embodiments, the housing 502 can include a handle 516 for carrying the sound system. The speaker housing 502 includes the low frequency speaker 504 on the top surface.

The low frequency speaker 504 can be the low frequency speakers (e.g., woofers) as described in relation to the sound systems 200 and 300. The housing 502 can also be supported via the support stands 512.

Figure 5B:
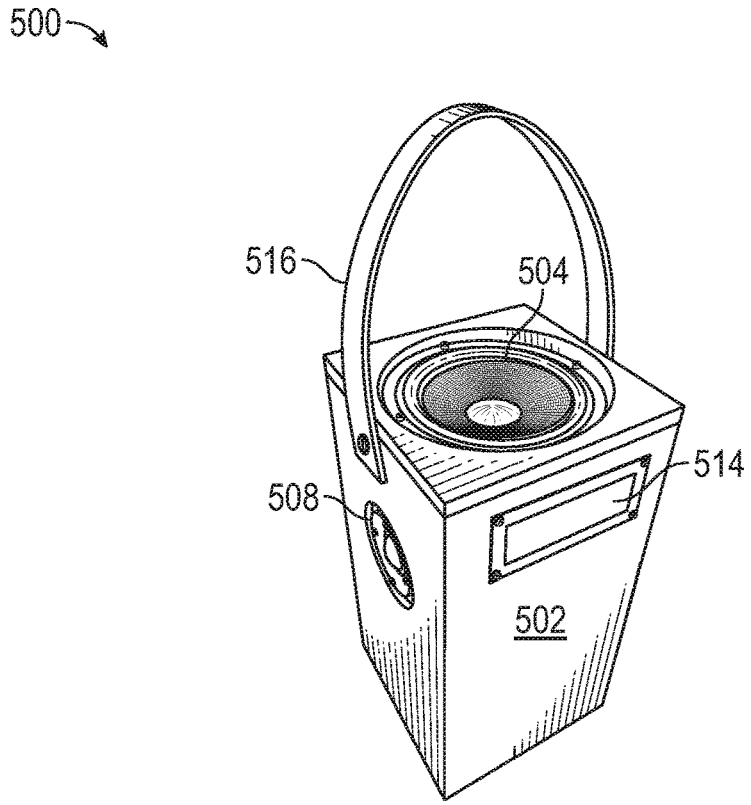
Figure 5C:
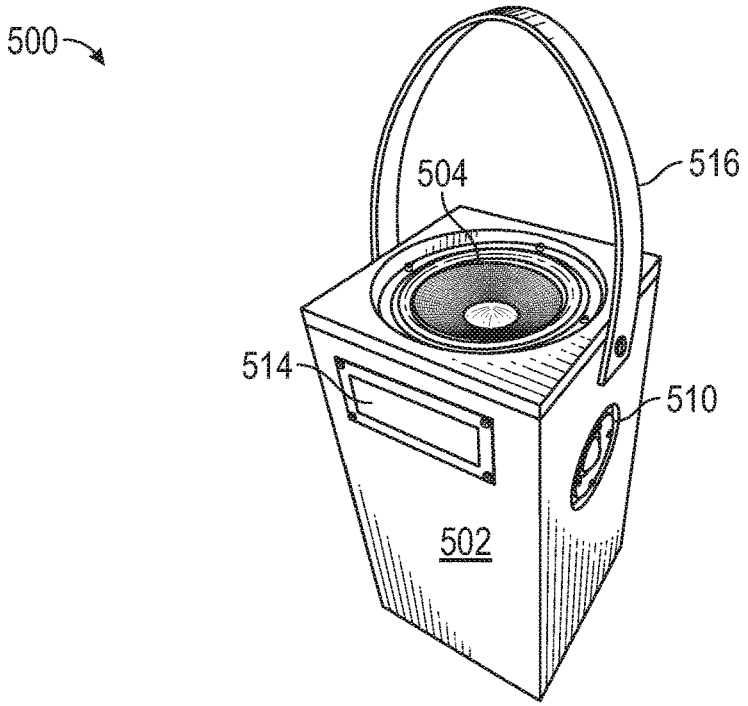

FIG. 5B illustrates a left side perspective view of the speaker housing 502. A high frequency speaker 508 is mounted on the left surface of the speaker housing 502. FIG. 5C illustrates a right side perspective view of the speaker housing 502. As described, the speaker housing 502 can include a high frequency speaker 510 on its right surface. The high frequency speakers 508 and 510 can be the high frequency speakers (e.g., tweeters) as described in relation to the sound systems 200 and 300.

Figure 5D:
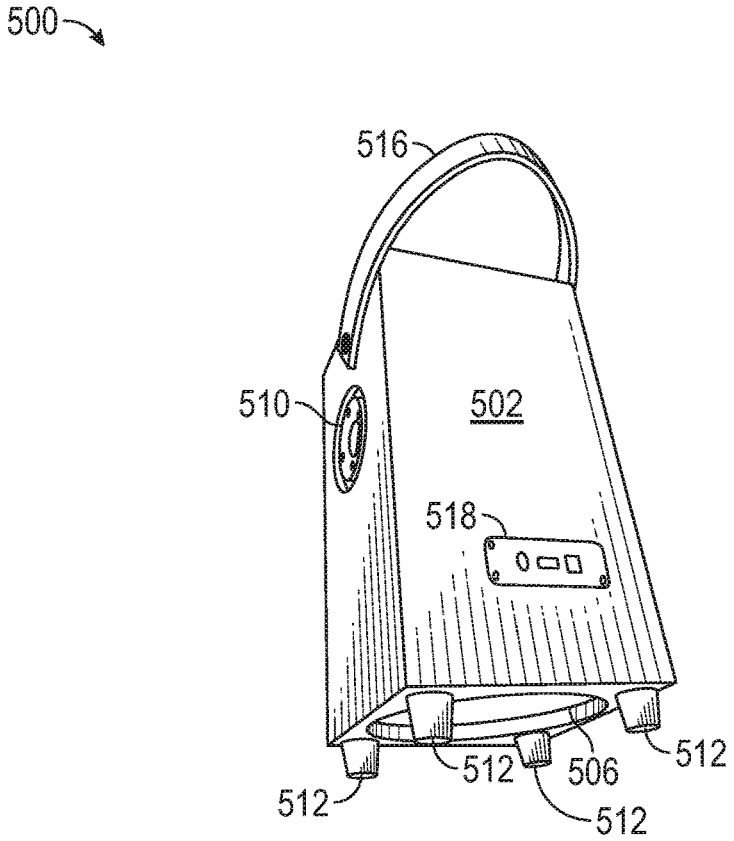

FIG. 5D illustrates a back and bottom perspective view of the speaker housing 502. The speaker housing 502 can include ports 518 for powering up or connecting the housed speaker system to external devices such as computers, laptops, tablets, smart phones, turntables or other analog or digital devices. In some embodiments, the speaker housing 502 and the housed speaker system may only include wireless connection capability for connecting with external devices. In other embodiments, the housed speaker system may include both wired connections and relevant ports and wireless connection capability. The ports 518 may include typical power or connection ports such as Universal Serial Bus (USB), Thunderbolt, 3.5 mm headphone jack, or other power or connection ports as dictated by application or usage for which the housed speaker system is intended. In some embodiments, the speaker housing 502 and the housed sound system may include portable energy storage such as secondary batteries and the associated connection ports for charging or recharging batteries. In some embodiments, the speaker housing 502 includes support stands 512 for supporting the speaker housing 502 on an external surface such as on a floor or on a table surface.

As described, configuring the low frequency speakers on top and bottom surfaces of the housing, where the bottom low frequency speaker is near the supporting surface on which the housing rests and directs its output towards the supporting surface, and where the low frequency speakers are driven with the same signal, undesirable speaker rattle effect can be minimized and auditory experience can be improved.

Advantageously, the sound systems implemented according to the embodiments described above enjoy pleasant auditory experience regardless of the distance of a listener to the location of the sound system within a reasonable distance from the sound system. For example, in some implementations, within a distance of approximately 20 to 30 feet from the described speaker system, whether the listener is close or far from the described sound system, the listener can hear nearly the same volume and can enjoy the same auditory experience. The top and bottom woofers each output a half-spherical sound wave. The bottom woofer is positioned toward the supporting surface, for example, within a few inches of a table surface or floor. Accordingly, when the listener is close to the described sound systems, the listener can hear the top woofer as the outputted sound waves from the bottom woofer hit the floor. As the listener walks away from the sound system, the half-spherical sound waves combine in distance and the listener can hear both woofers. A volume droop due to distance is compensated by sound waves, from the two woofers, combining in distance, thereby creating nearly the same auditory experience as the listener might have when near the sound system.

In some embodiments, the height of the speaker system housing or the distance between the low frequency woofer speakers can be chosen such that the droop in amplitude of the sound waves (or the signal strength) relative to distance from the sound system can be improved compared to conventional sound systems lacking low frequency speakers on top and bottom surfaces of their housing. Using the described technology, the signal strength can remain relatively uniform for distances of, for example, up to 30 feet from the sound system. For example, in conventional systems, the signal strength can droop by 50-80% when the listener moves from 3 feet of the sound system to 30 feet of the sound system. Using the embodiments described herein, the droop in signal strength, as the listener's location changes relative to the sound system, can improve by at least 20% compared to conventional systems that lack the low frequency speaker placement on their top and bottom surfaces. For example, in some embodiments, a range of 10 inches to 14 inches in the distance between the top and bottom speakers can improve volume droop (relative to distance from the speaker housing) compared to sound systems lacking top and bottom mounted low frequency speakers.

The systems and methods described in relation to high and low frequencies and the disclosed ranges, are not meant to be limiting to only two classes of frequencies, and their respective ranges described above. A person with ordinary skill in the art can envision compartmentalizing the audible frequency range in a different fashion and using appropriate audio speakers without departing from the spirit of the embodiments described herein.

What is claimed is:

1. An audio system comprising:

an input configured to receive left and right stereo input signals;

a left filter configured to receive the left stereo input signal and isolate left low frequency signal and left high frequency signal;

a right filter configured to receive the right stereo input signal and isolate right low frequency signal and right high frequency signal;

left and right high frequency speakers;

top and bottom low frequency speakers, positioned to output sound in opposite directions, wherein the bottom low frequency speaker is positioned to output sound toward an external supporting surface;

left high frequency amplifier configured to receive and amplify the left high frequency signal and drive the left high frequency speaker with the amplified left high frequency signal;

right high frequency amplifier configured to receive and amplify the right high frequency signal and drive the right high frequency speaker with the amplified right high frequency signal;

a summing amplifier configured to receive the left and right low frequency signals and generate a combined low frequency signal; and a low frequency woofer amplifier coupled to the top and bottom low frequency speakers and configured to receive the combined low frequency signal, output an amplified combined low frequency signal and drive the top and bottom low frequency speakers with the amplified combined low frequency signal.

2. The audio system of claim 1, further comprising a housing, wherein the housing comprises top and bottom surfaces, and the top low frequency speaker is mounted on the top surface of the housing and the bottom low frequency speaker is mounted on the bottom surface of the housing, wherein the bottom surface of the housing supports the housing on the external supporting surface and further comprises support features for supporting the housing on the external supporting surface, and the top and bottom surfaces comprise separate surfaces of the housing.

3. The audio system of claim 2, wherein the housing further comprises side surfaces and the left and right high frequency speakers are mounted on opposing or adjacent side surfaces of the housing.

4. The audio system of claim 3 further comprising high frequency speakers on all side surfaces of the housing.

5. The audio system of claim 2, wherein the left and right high frequency speakers are replaced with left and right mid-range speakers, the left filter is configured to filter left midrange frequencies, the right filter is configured to filter right midrange frequencies, the left and right high frequency amplifiers are configured to amplify the left and the right midrange frequencies and drive the left and the right mid-range speakers.

6. The audio system of claim 5, wherein the housing further comprises side surfaces and the mid-range speakers are mounted on opposing or adjacent side surfaces of the housing.

7. The audio system of claim 6, further comprising mid-range speakers on all side surfaces of the housing.

8. The audio system of claim 2, wherein a distance between the top and bottom low frequency speakers in the housing range from about 10 to 14 inches such that volume droop, within a distance of about 30 feet from the housing, is improved by at least 20% compared to sound systems lacking low frequency speakers on top and bottom surfaces.

9. The audio system of claim 1, wherein the low frequency amplifier further comprises a volume control functioning as bass control.

10. The audio system of claim 1, wherein the low frequency signals comprise signals with frequencies less than 500 Hz and the high frequency signals comprise signals with frequencies from 500 Hz to about 20 KHz.

11. An audio system comprising:

an input configured to receive left and right stereo input signals;

a left filter configured to receive the left stereo input signal and filter a left high frequency signal;

a right filter configured to receive the right stereo input signal and filter a right high frequency signal;

left and right high frequency speakers;

top and bottom low frequency speakers, positioned to output sound in opposite directions, wherein the bottom low frequency speaker is positioned to output sound toward an external supporting surface;

a left high frequency amplifier configured to receive and amplify the left high frequency signal and drive the left high frequency speaker with the amplified left high frequency signal;

a right high frequency amplifier configured to receive and amplify the right high frequency signal and drive the right high frequency speaker with the amplified right high frequency signal;

a summing amplifier configured to receive the left and right stereo input signals and generate a summed signal;

a low pass filter configured to receive the summed signal and generate a low frequency summed signal; and a low frequency woofer amplifier coupled to the top and bottom low frequency speakers and configured to receive the low frequency summed signal, output an amplified low frequency summed signal and drive the top and bottom low frequency speakers with the amplified low frequency summed signal.

12. The audio system of claim 11 further comprising a housing, wherein the housing comprises top and bottom surfaces, and the top low frequency speaker is mounted on the top surface of the housing and the bottom low frequency speaker is mounted on the bottom surface of the housing, wherein the bottom surface of the housing supports the housing on the external supporting surface and further comprises support features for supporting the housing on the external supporting surface, and the top and bottom surfaces comprise separate surfaces of the housing.

13. The audio system of claim 12, wherein the housing further comprises side surfaces and the left and right high frequency speakers are mounted on opposing or adjacent side surfaces of the housing.

14. The audio system of claim 13 further comprising high frequency speakers on all side surfaces of the housing.

15. The audio system of claim 12, wherein the left and right high frequency speakers are replaced with left and right mid-range speakers, the left filter is configured to filter left midrange frequencies, the right filter is configured to filter right midrange frequencies, the left and right high frequency amplifiers are configured to amplify the left and the right midrange frequencies and drive the left and the right mid-range speakers.

16. The audio system of claim 15, wherein the housing further comprises side surfaces and the mid-range speakers are mounted on opposing or adjacent side surfaces of the housing.

17. The audio system of claim 16 further comprising mid-range speakers on all side surfaces of the housing.

18. The audio system of claim 12 wherein a distance between the top and bottom low frequency speakers in the housing range from about 10 to 14 inches such that volume droop, within a distance of about 30 feet from the housing, is improved by at least 20% compared to sound systems lacking low frequency speakers on top and bottom surfaces.

19. The audio system of claim 12, wherein the low frequency amplifier further comprises a volume control functioning as bass control.

20. A method of reproducing stereo audio comprising:

receiving left and right stereo input signals;

filtering the left stereo input signal to isolate a left high frequency signal;

amplifying the left high frequency signal;

driving a left high frequency speaker with the amplified left high frequency signal;

filtering the right stereo input signal to isolate a right high frequency signal;

amplifying the right high frequency signal;

driving a right high frequency speaker with the amplified right high frequency signal;

summing the left and right stereo input signals into a summed signal;

filtering the summed signal to isolate a low frequency summed signal;

amplifying the low frequency summed signal; and driving a top low frequency speaker and a bottom low frequency speaker with the amplified low frequency summed signal, wherein the top and bottom low frequency speakers are positioned to output sound in opposite directions, wherein the bottom low frequency speaker is positioned to output sound toward an external supporting surface.

21. The method of claim 20 further comprising providing a housing, wherein the housing comprises top and bottom surfaces, and the top low frequency speaker is mounted on the top surface of the housing and the bottom low frequency speaker is mounted on the bottom surface of the housing, wherein the bottom surface of the housing supports the housing on external surface and further comprises support features for supporting the housing on the external surface, and the top and bottom surfaces comprise separate surfaces of the housing.

22. The method of claim 20 further comprising: mounting the bottom low frequency speaker on a speaker housing supported on an external supporting surface; and directing the output of the bottom low frequency speaker toward the external supporting surface.

* * * * *